US006601324B2

(12) United States Patent
Iwasa et al.

(10) Patent No.: US 6,601,324 B2
(45) Date of Patent: Aug. 5, 2003

(54) CONSTRUCTION MACHINE

(75) Inventors: Kazumichi Iwasa, Tokyo (JP); Masanori Tsuji, Tokyo (JP); Yuichiro Yamauchi, Tokyo (JP); Takahiro Goto, Kobe (JP)

(73) Assignee: Shin Caterpillar Mitsubishi, Ltd., Atokyo (JP)

( * ) Notice: Subject to any disclaimer, the term of this patent is extended or adjusted under 35 U.S.C. 154(b) by 0 days.

(21) Appl. No.: 10/169,398

(22) PCT Filed: Oct. 16, 2001

(86) PCT No.: PCT/JP01/09063

§ 371 (c)(1),
(2), (4) Date: Jul. 2, 2002

(87) PCT Pub. No.: WO02/40782

PCT Pub. Date: May 23, 2002

(65) Prior Publication Data

US 2003/0056404 A1 Mar. 27, 2003

(30) Foreign Application Priority Data

Nov. 14, 2000 (JP) ..... 2000-346642

(51) Int. Cl.[7] ..... E02F 9/18
(52) U.S. Cl. ..... 37/347; 37/466
(58) Field of Search ..... 37/347, 466

(56) References Cited

FOREIGN PATENT DOCUMENTS

| | | |
|---|---|---|
| JP | 4-055527 | 2/1992 |
| JP | 9-209401 | 8/1997 |
| JP | 2000-080679 | 3/2000 |
| JP | 2000-144811 | 5/2000 |
| JP | 2000-204588 | 7/2000 |

*Primary Examiner*—Christopher J. Novosad
(74) *Attorney, Agent, or Firm*—Millen, White, Zelano & Branigan, P.C.

(57) ABSTRACT

A construction machine having an engine arranged along a counter weight, wherein the intake air pipe of the engine is passed between the counter weight and the engine without the need of installing the counter weight spaced from the engine, so that the counter weight protrudes outwardly less. This is accomplished by a piping space (44) of a recessed shape formed in the surface (36) of the counter weight (18) facing the engine (4) allowing the intake air pipe (28) to pass therethrough.

2 Claims, 5 Drawing Sheets

CONSTRUCTION MACHINE

TECHNICAL FIELD

The present invention relates to a construction machine and, more specifically, to a construction machine in which an engine is arranged along a counter weight which is a balance weight of the construction machine.

BACKGROUND ART

Hydraulic excavators and wheel loaders which are typical construction machines are equipped with a counter weight at a rear end portion of a machine body to maintain a balance with the weight of working equipment installed on the front side of the machine body and with a load exerted thereon. The counter weight is so heavy that it occupies a large portion on the machine body. On the inner side of the counter weight in the machine body, an engine such as a diesel engine which is a power source of moving the construction machine is arranged along the counter weight.

The counter weight defines the contour of the rear end portion of the machine body of the construction machine. In order to maintain good rear view from the operator in a cab installed on the machine body, in order that the counter weight will not come in contact with the obstacles in the surrounding and in order to decrease the turning radius of the outside edge of the machine body, which pivots, of a construction machine such as a hydraulic excavator, therefore, it is desired to install the counter weight on the inside of the machine body as close as possible to the engine side so will not to much protrude rearward and so will not to much protrude upward, either.

The engine is equipped with heat-exchanging units such as a fan for producing the cooling air, a radiator through which the cooling air flows, an oil cooler and the like. Further, an air cleaner which is an intake air filter of the engine is installed on the side of the outside edge of the machine body opposite to the engine with the heat-exchanging units interposed therebetween in order to take in the open air of a low temperature. The construction machine is operated under severe load conditions and under severe environmental conditions. Therefore, the heat-exchanging units are formed in a large size and occupy a large space for installation on the machine body. The intake air pipe connecting the air cleaner to the engine is arranged between the heat-exchanging units and the counter weight in the portion of the heat-exchanging units or above the heat-exchanging units.

DISCLOSURE OF THE INVENTION

The conventional construction machine of the form as described above, however, involves problems that must be solved as described below.

(1) Rearward Protrusion of the Counter Weight

The intake air pipe of the engine has a relatively large diameter. To pass the intake air pipe between the engine and the counter weight, a piping space must be secured by broadening therebetween. For this purpose, the counter weight is moved toward the rear side of the machine body for installation. Therefore, the rear end portion of the machine body protrudes by an amount by which the counter weight is moved rearward. This gives the possibility of hindering the rear view of the operator and causing an increase in the turning radius of the outside edge of the machine body, whereby a problem will arise that the working efficiency of the construction machine deteriorates.

(2) Protruding Upward of the Machine Body

When the intake air pipe is passed above the heat-exchanging units in order to avoid protruding rearward of the counter weight, the hood of the machine body covering the upper side of the engine becomes high and the machine body protrudes further upward, hindering the rear view from the cab.

The present invention was achieved in view of the above-mentioned circumstances, and its technical assignment is to provide a construction machine in which an engine is arranged along a counter weight, wherein the intake air pipe of the engine is passed between the counter weight and the engine without the need of installing the counter weight separated away from the engine, so that protruding outward of the counter weight can be lessened.

Namely, according to the present invention, as a construction machine to solve the above-mentioned technical problems, there is provided a construction machine comprising a counter weight which is a balance weight of the construction machine, an engine arranged along the counter weight and an intake air pipe connecting the engine to an air cleaner which is an intake air filter of the engine, wherein a piping space of a recessed shape is formed in the facing surface of the counter weight facing the engine so as to pass the intake air pipe therethrough.

Further, by passing the intake air pipe through the piping space formed in the counter weight, the engine and the counter weight can be arranged without being separated away from each other.

In a preferred embodiment, the surface facing the engine is formed being curved in a direction to cover the engine.

The counter weight is so formed as to cover the engine and consequently, the weight of the engine efficiently works as a balance weight, making, as a whole, it possible to decrease the protruding rearward of the counter weight.

Further, a fan driven by the engine and a heat-exchanging unit through which the cooling air produced by the fan flows are provided, the air cleaner is installed on the side opposite to the heat-exchanging unit with respect to the engine, and the intake air pipe is arranged passing through the piping space in a portion where the heat-exchanging unit and the counter weight are neighboring each other.

By passing the intake air pipe through the piping space of the counter weight in a portion of the heat-exchanging unit that occupies a large space, the problem of protrusion of the counter weight is eliminated.

BEST MODE FOR CARRYING OUT THE INVENTION

A construction machine constituted according to the present invention will now be described hereinafter in further detail with reference to the accompanying drawings illustrating a preferred embodiment of a hydraulic excavator which is a typical construction machine.

Figure 1:
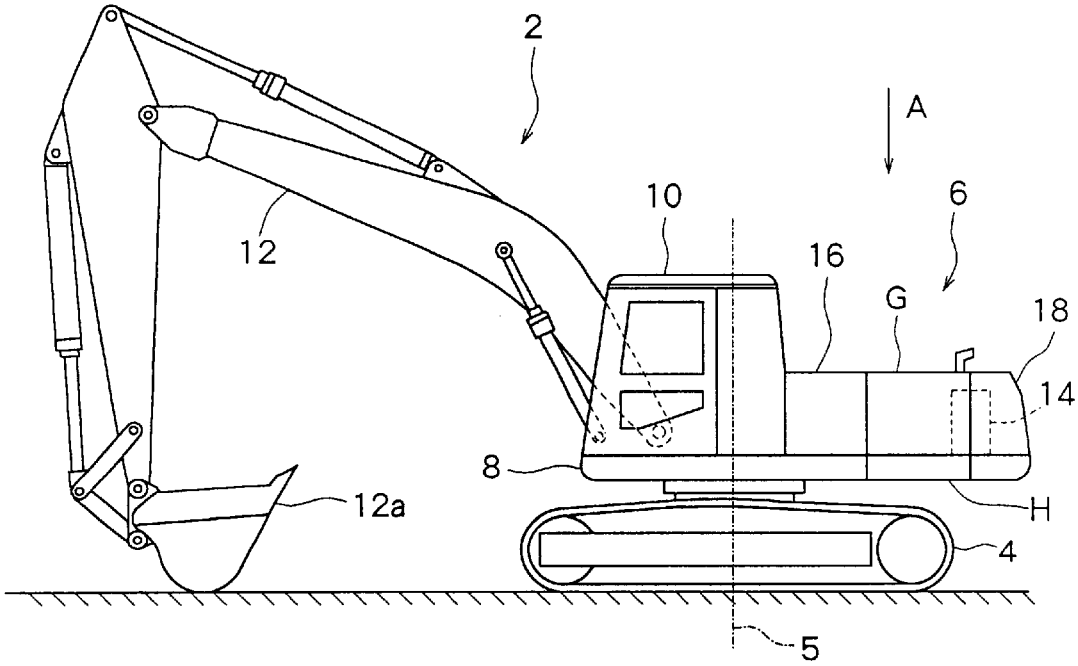
FIG. 1 is a side view of a hydraulic excavator which is a typical construction machine constituted according to the present invention.

Referring to FIG. 1, a hydraulic excavator which is generally designated by numeral 2 includes an under carriage 4 and a swing table 6 mounted on the under carriage 4 so as to freely turn about a swing axis 5 which extends substantially vertically. A cab 10 and a working equipment 12 having a bucket 12*a* are arranged on the front side (left side in FIG. 1) on a swing table frame 8 of the swing table 6. On the rear side (right side in FIG. 1) of the cab 10, there are arranged an engine room 16 accommodating an engine 14 and a counter weight 18 which is a balance weight, at the rear end portion.

Figure 2:
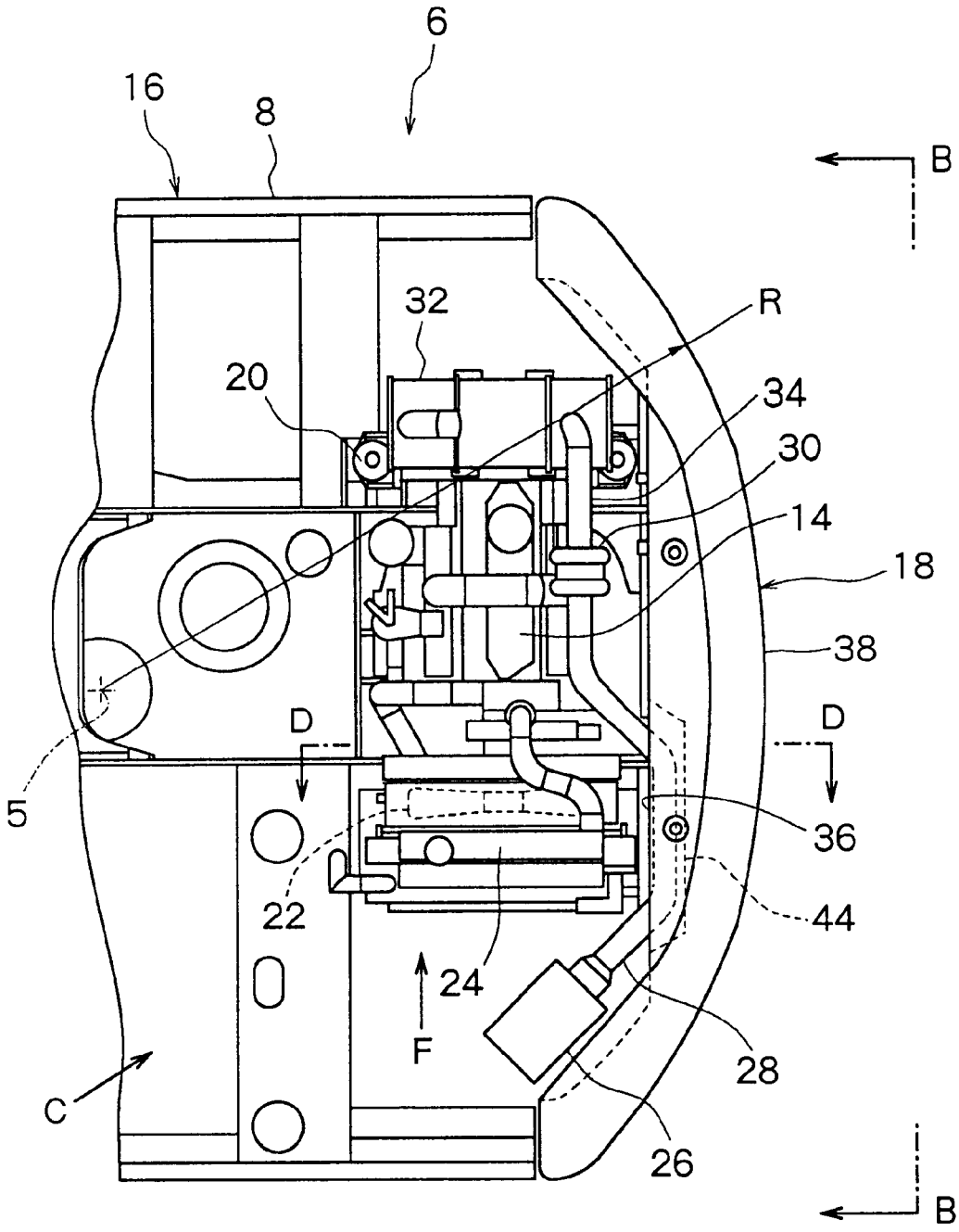
FIG. 2 is a view illustrating, on an enlarged scale, a portion of chiefly an engine and a counter weight while removing some members from the swing table, as viewed from a direction of an arrow A in FIG. 1.
Figure 3:
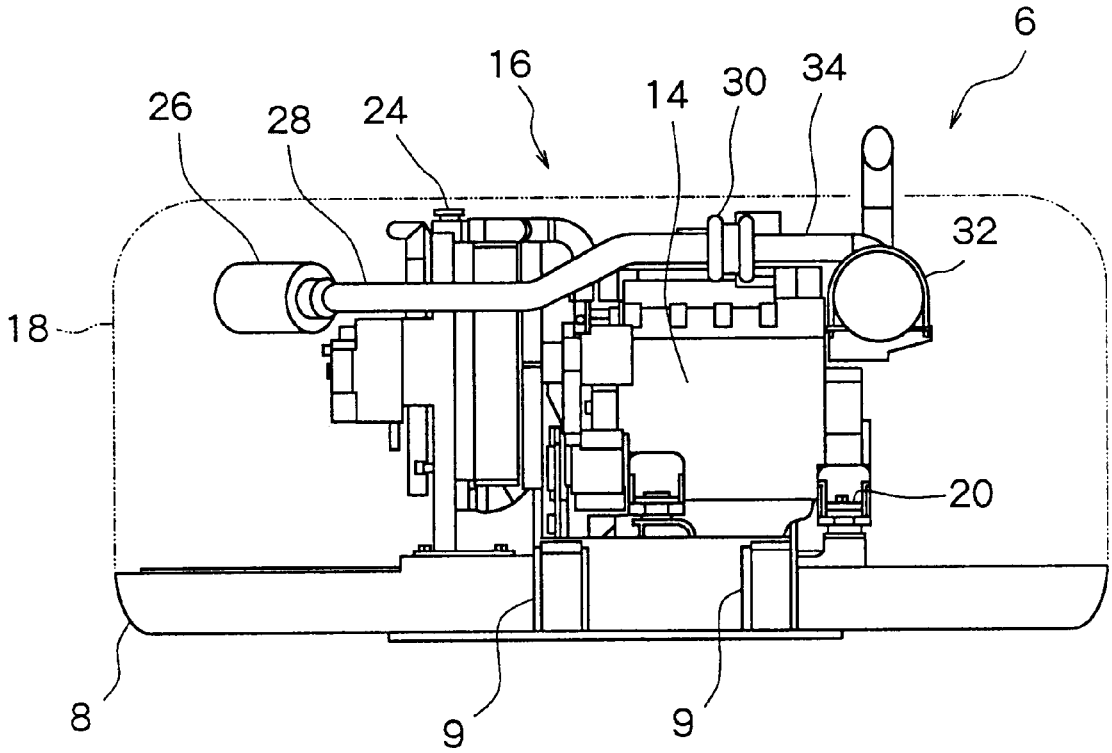
FIG. 3 is a rear view illustrating a portion of chiefly the engine while removing the counter weight from the swing table, as viewed in a direction of arrows B—B in FIG. 2.

With reference to FIGS. 2 and 3, in the engine room 16 is arranged an engine 14 which is constructed by a diesel engine on the swing table frame 8 via a plurality of mounting rubbers 20 in the right-and-left direction (up-and-down direction in FIG. 2) along the counter weight 18. The counter weight 18 is arranged over the full width of the swing table 6 in the right-and-left direction and is mounted on a pair of main frames 9 and 9 of the swing table frame 8.

The engine 14 is equipped, on one end side thereof (lower end side in FIG. 2), with a fan 22 that is driven by the engine 14 to produce the cooling air and a heat-exchanging unit 24 which is arranged facing the fan 22 and through which the cooling air flows. The heat-exchanging unit 24 comprises a radiator for cooling the cooling water of the engine 14 and an oil cooler for cooling the operation oil of the working equipment 12, and is formed in a rectangular, nearly square, parallelopiped shape with its surface facing the fan 22. As viewed from an end, the heat-exchanging unit 24 is formed in a size large enough to meet the size of the engine 14, so that the engine 14 endures severe operating conditions under which the hydraulic excavator 2 is operated. As indicated by an arrow F (FIG. 2), the cooling air produced by the fan 22 flows in toward the heat-exchanging unit 24 from the outside of the swing table 6, flows through the heat-exchanging unit 24, flows around the engine 14, and is exhausted to the outside of the swing table 6. An air cleaner 26 which is an intake air filter of the engine 14 is arranged in space into which the cooling air flows between the heat-exchanging unit 24 and the left side (lower side in FIG. 2) of the swing table 6. The air cleaner 26 is mounted on a member (not shown) forming the swing table frame 8 or the engine room 16. The air cleaner 26 is connected, through an intake air pipe 28, to the housing on the air-intake side of a turbo charger 30 which is installed on the central upper portion of the engine 14. The housing on the air-exhaust side of the turbo charger 30 is connected, through an exhaust pipe 34, to a muffler 32 provided at an end side of the engine 14 on the side opposite to the end side where the heat-exchanging unit 24 is provided. The intake air pipe 28 is arranged in nearly the horizontal direction along the side surface of the heat-exchanging unit 24 on the side of the counter weight 18. The intake air pipe 28 is formed of a steel pipe or a rubber pipe, and has a relatively large diameter among the pipes arranged around the engine 14.

Figure 4:
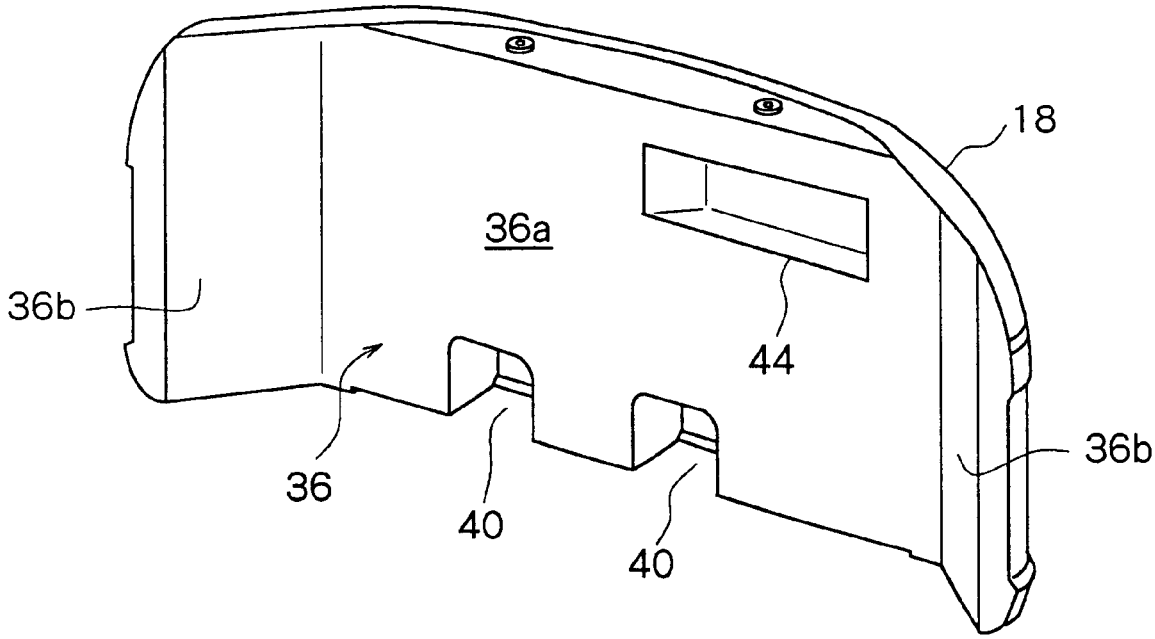
FIG. 4 is a perspective view of the counter weight as viewed from the upper side in a direction of an arrow C in FIG. 2.
Figure 5:
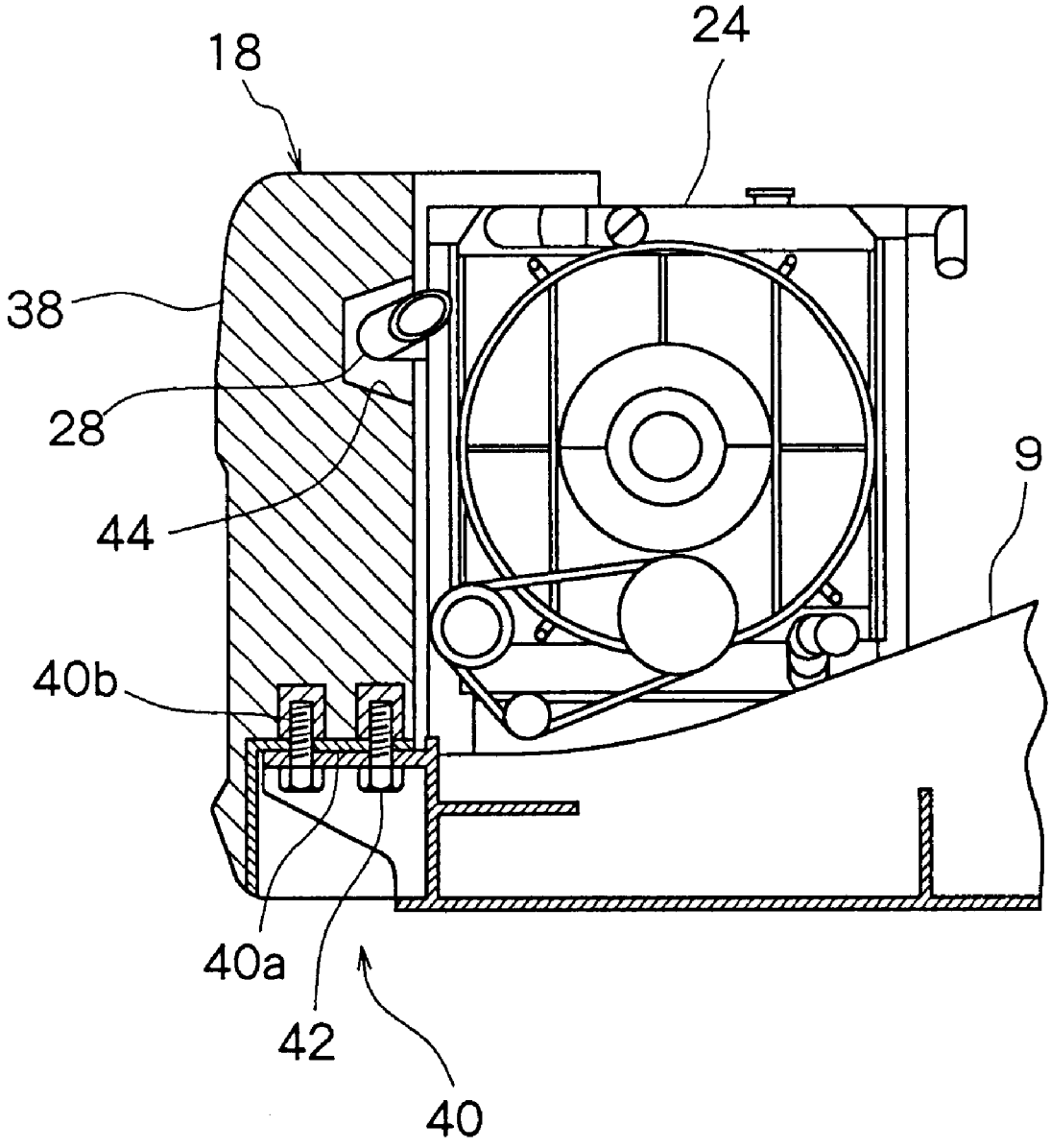
FIG. 5 is a sectional view illustrating chiefly a portion of the counter weight as viewed from a direction of arrows D—D in FIG. 2.

With reference to FIGS. 4 and 5 together with FIGS. 1 to 3, the counter weight 18 is formed of cast iron as a unitary structure. Viewed from the upper side (state shown in FIG. 2), the counter weight 18 has its whole shape curved in a direction to cover the engine 14, has a width in the right-and-left direction (up-and-down direction in FIG. 2) which is substantially the same as the width of the swing table 6, and has a height in the up-and-down direction (up-and-down direction in FIG. 3) which is substantially the same as a height of from the upper surface G (FIG. 1) of the engine room 16 up to the lower end portion H (FIG. 1) of the swing table frame 8. The surface 36 facing the engine 14 comprises a central flat surface portion 36*a* extending nearly in parallel with the engine in the right-and-left direction and tilted surface portions 36*b* and 36*b* each tilted toward the side of the engine 14 from the right and left ends of the flat surface portion 36*a*. The rear end 38 side of the counter weight 18 is formed in nearly an arcuate shape as a whole to meet the curvature of the surface 36 facing the engine. A pair of recessed portions 40 and 40 are formed in the lower central portions of the counter weight 18 on the side of the surface 36 facing the engine, so as to allow the counter weight to mount on the pair of main frames 9 and 9 of the swing table frame 8. In each recessed portion 40 are formed a mounting surface 40*a* and a plurality of threads 40*b* for mounting. The counter weight 18 is mounted on the main frames 9 and 9 of the swing table frame 8 by using the mounting surfaces 40*a*, threads 40*b* and bolts 42.

A recessed piping space 44 is formed in the flat surface portion 36*a* of the surface 36 facing the engine, the recessed piping space 44 extending in the horizontal direction so as to correspond to the position where the intake air pipe 28 is arranged and being open in a rectangular shape. The piping space 44 is formed in the shape of a trapezoidal groove with the open side expanding. The piping space 44 is of such a size that allows the intake air pipe 28 to be arranged maintaining a gap.

The intake air pipe 28 is mounted on the swing table 6 in such a way that the intake air pipe 28 is arranged between the engine 14 and the air cleaner 26 beforehand and then, the counter weight 18 is mounted. Or, the counter weight 18 is first mounted on the main frame 9 and then, the intake air pipe 28 is arranged between the engine 14 and the air cleaner 26 passing through the piping space 44.

Described below is the function of the above-mentioned construction machine.

(1) Intake Air Pipe

The intake air pipe 28 passes through the piping space 44 formed in the counter weight 18. Unlike the prior art, therefore, the counter weight needs not be moved rearward for passing the intake air pipe. Since the protrusion is decreased by an amount by which the counter weight would have been moved, the rear view of the operator is not impaired and, besides, the turning radius R (FIG. 2) of the outside edge portion of the machine body can be decreased. Moreover, since the intake air pipe 28 does not pass above the heat-exchanging unit 24, such a problem is eliminated that the upper surface G (FIG. 1) of the engine room 16 become so high as to interrupt the rear view.

(2) Counter Weight

Since the surface 36 of the counter weight 18 facing the engine is curved in a direction to cover the engine 14, it is allowed to move the engine 14 toward the rear side of the machine body to approach the counter weight 18 in the back-and-forth direction of the swing table 6. Therefore, the weight of the engine 14 can be effectively utilized as a counter weight. Accordingly, the weight of the counter weight itself can be decreased correspondingly, so that it becomes possible to decrease the amount of protruding rearward.

Though the invention was described above in detail by way of an embodiment, it should be noted that the present invention is in no way limited to the above embodiment only but can also be modified or changed in a variety of ways within the scope of the present invention, as described below.

(1) Piping Space

In the embodiment of the present invention, the piping space 44 in the counter weight 18 has an opening of a rectangular shape with its cross section being a trapezoidal shape. However, the shape of the opening and its cross-sectional shape as well as the size thereof may be suitably changed depending upon the shape of the intake air pipe 28 and a position where the intake air pipe 28 passes through.

(2) Counter Weight

In the embodiment of the present invention, the surface 36 of the counter weight 18 facing the engine is curved in plan view (FIG. 2). The surface 36 of the counter weight 18 facing the engine, however, may be curved in side view (FIG. 5).

(3) Counter Weight

The surface 36 of the curved shape facing the engine may be formed flat in parallel with the engine 14 over the whole surface thereof depending upon the structure and size of the machine body of the construction machine.

(4) Counter Weight

In the embodiment of the present invention, the counter weight 18 is formed of a casting as a unitary structure. The counter weight 18, however, may be formed in the shape of a hollow container using a steel plate or the like, and may be filled with scrap iron, concrete or the like therein.

(5) Construction Machine

Though the embodiment of the present invention has dealt with the hydraulic excavator 2 as a construction machine, the invention can be advantageously used for any construction machine such as a wheel loader, a crane truck or the like, which is equipped with the counter weight which is a balance weight.

In the construction machine constituted according to the present invention, there is provided a construction machine having an engine arranged along the counter weight, wherein the intake air pipe of the engine is passed between the counter weight and the engine without the need of installing the counter weight separated away from the engine, so that the protruding outward of the counter weight is lessened.

What is claimed is:

1. A construction machine comprising:

a counter weight which is a balance weight for the construction machine, the counter weight having a facing surface; an engine positioned adjacent to the facing surface of the counter weight and having an intake air pipe connecting an air intake of the engine to an air cleaner which includes an intake air filter for the engine, a piping space recessed in the facing surface of the counter weight, the intake air pipe extending in the piping space;

a fan driven by the engine and a heat exchanging unit proximate the engine through which cooling air produced by the fan flows, said air cleaner being installed on a side of the engine opposite to a side of the engine on which said heat-exchanging unit is installed, said intake air pipe being arranged to pass a portion thereof through said piping space adjacent to where said heat-exchanging unit and said counter weight are proximate one another.

2. The construction machine according to claim 1, wherein the counter weight has a surface facing said engine which is curved in a direction to cover said engine.

* * * * *